US009644788B1

(12) United States Patent
Mariner, Jr.

(10) Patent No.: US 9,644,788 B1
(45) Date of Patent: May 9, 2017

(54) SPORTS BOARD HANGER

(71) Applicant: Algia Reginald Mariner, Jr., Berlin, MD (US)

(72) Inventor: Algia Reginald Mariner, Jr., Berlin, MD (US)

( * ) Notice: Subject to any disclaimer, the term of this patent is extended or adjusted under 35 U.S.C. 154(b) by 78 days.

(21) Appl. No.: 14/289,604

(22) Filed: May 28, 2014

(51) Int. Cl.
*A47F 5/01* (2006.01)
*F16M 13/02* (2006.01)

(52) U.S. Cl.
CPC ..... *F16M 13/02* (2013.01)

(58) Field of Classification Search
CPC ..... B63B 35/7946; A47F 5/01; A63C 11/028; Y10S 224/917
See application file for complete search history.

(56) References Cited

U.S. PATENT DOCUMENTS 3,486,463 A * 12/1969 St Cyr ..... B61B 11/00 104/173.2
4,878,585 A 11/1989 Orestano
5,107,995 A 4/1992 Simpson
5,141,116 A 8/1992 Mojica
D396,371 S * 7/1998 Oliver ..... D6/552
5,826,908 A * 10/1998 McBride ..... A63C 11/028 211/70.5
5,884,781 A * 3/1999 Ehrhart ..... A63C 11/028 211/60.1
5,950,844 A * 9/1999 Taylor ..... A47B 43/00 211/118
6,386,379 B1 * 5/2002 Battaglia ..... A47B 96/00 211/106
6,712,226 B1 * 3/2004 Williams, Jr. ..... A47B 81/00 211/70.5
6,886,791 B2 * 5/2005 Dettorre ..... A47B 81/00 211/85.7
6,935,517 B1 * 8/2005 Reed ..... A47B 81/00 211/70.5
D650,460 S * 12/2011 Krol, II ..... D21/771
9,346,524 B2 * 5/2016 Dubois ..... B63B 35/7946
2002/0050725 A1 * 5/2002 Lang ..... B63B 35/7946 294/142
2006/0180728 A1 * 8/2006 Abrantes ..... A47F 5/0006 248/328
2006/0289373 A1 * 12/2006 Kahn ..... B63B 35/7946 211/85.7
2007/0102380 A1 * 5/2007 Shaw ..... A47B 81/005 211/70.5
2007/0125731 A1 6/2007 Waterman
2009/0001034 A1 1/2009 Hazan
2009/0020487 A1 * 1/2009 Wood ..... A63C 11/028 211/70.5
2009/0032485 A1 * 2/2009 Berry ..... A63C 11/028 211/85.7

(Continued)

FOREIGN PATENT DOCUMENTS

WO WO 2006/002456 1/2006
WO WO 2007/070918 6/2007

*Primary Examiner* — Bradley Duckworth

(57) ABSTRACT

One embodiment of a sports board hanger which can be attached to a sports board such as a surfboard, enable it to be hung from an elevated rod, hook, peg or other object, remain in place while the board is raised or lowered, can be quickly attached and detached for reuse without use of fasteners such as screws, and can be used with fins installed on a board.

12 Claims, 12 Drawing Sheets

(56) References Cited

U.S. PATENT DOCUMENTS

| | | | | |
|---|---|---|---|---|
| 2012/0068029 | A1* | 3/2012 | Elvira | A63C 11/028 248/222.14 |
| 2012/0149259 | A1* | 6/2012 | Proton | B63B 35/7946 441/75 |
| 2012/0305722 | A1* | 12/2012 | Krosky | B63B 35/7946 248/224.8 |
| 2014/0001133 | A1* | 1/2014 | Shaghafi | A47B 43/003 211/85.7 |
| 2014/0021155 | A1* | 1/2014 | Ferre-Rangel | B63B 35/7946 211/182 |
| 2015/0129518 | A1* | 5/2015 | Ho | A47J 47/16 211/41.2 |
| 2015/0314838 | A1* | 11/2015 | Adolpho | F16B 2/08 248/316.1 |
| 2015/0329185 | A1* | 11/2015 | Dubois | A63C 11/00 248/558 |

* cited by examiner

SPORTS BOARD HANGER

CROSS-REFERENCE TO RELATED APPLICATIONS

This application claims the benefit of provisional patent application Ser. No. 61/829,246 filed 2013 May 30 by the present inventor.

BACKGROUND—PRIOR ART

The following is a tabulation of some prior art that presently appears relevant:

| U.S. Patents | | |
|---|---|---|
| Pat. No. | Issue Date | Patentee |
| 4,878,585 | Nov. 7, 1989 | Orestano |
| 5,107,995 | Apr. 28, 1992 | Simpson |
| 5,141,116 | Aug. 25, 1992 | Mojica |
| US 2009/0001034 A1 | Jan. 1, 2009 | Hazan |
| D 396,371 | Jul. 28, 1998 | Oliver |
| US 2007/0125731 A1 | Jun. 7, 2007 | Waterman |
| D 650460 S1 | Dec. 13, 2011 | Krol |

| Foreign Patent Application Publication | | | |
|---|---|---|---|
| Foreign Doc. Nr. | Type | Publication Date | Patentee |
| WO 2007/070918 A1 | PCT | Jun. 28, 2007 | Buchmann |
| WO 2006/002456 A1 | PCT | Jan. 12, 2006 | Ocean & Earth |

Storage of sports boards such as surfboards, skateboards, snowboards, wake boards, kite boards, skim boards, body boards, snow skis, and water skis when not in use can be cumbersome. Many owners have multiple boards of/for multiple types and uses. Without an organized storage system, many owners typically lean their boards against a wall or in a corner. This can be problematic for the following reasons: including it takes up floor space which could serve other uses, the boards can fall over or slide out at the bottom resulting in their damage or damage to adjacent surroundings, it is difficult to grab a board in the middle of a pile for use without removing several other boards, and it is difficult of store different board types in the same area. Other typical storage options include building or installing racks to stack them vertically along a wall which still resulting in loss of floor space, some potential for them to fall over causing damage, and it is difficult of store different board types in one rack type. Other options include wall or ceiling mounted racks which store the boards in a horizontal orientation. This method can be better than not using a rack but still uses a lot of wall or ceiling area to store a minimal number of boards. Further, the racks have to be mechanically attached to the wall or ceiling and are not easily relocated, and can be expensive to purchase and install.

Hanging boards vertically has the advantage of utilizing the upper area of wall space, so the floor area below is less obstructed and can be used for other uses. Also, the boards have less potential of falling or sliding out resulting in damage; and it is easier to grab a board in the middle of a group of boards. One elevated rod can be used to support multiple board types without having to purchase and install various types of dedicated racks. In addition, many owners like to display their board for view in an elevated position.

There is prior art which can be used to hang a surfboard in a vertical position, such as PCT International Publication Number WO 2007/070918 A1 by Buchmann. However, it cannot be used with fins installed on the board. This prior art is primarily used by retail shops to support new boards on display until they are purchased and the fins are installed. Most board owners do not regularly remove their fins making this prior art not useful for most end board users. This prior art requires mechanical attachment to the board via the screws which otherwise attach the fins. Having to use the screws to install and remove it is inconvenient and time consuming. Further, this prior art system cannot be used to support boards with permanent, fixed or glassed-on fins.

There is prior art which can be used to hang a skateboards in a vertical position. Most of this prior art consist of racks or supports requiring mechanical attachment to walls and is not very versatile. There is a design (U.S. Pat. No. Des. 396,371 by Oliver) which consists of a metal wire bent to receive the ends of the truck axles at the front of the board; however it needs to be pre-hung on an elevated surface prior to supporting the board. Further, it does not have an open top hook so it cannot be easily used to raise and hang a skateboard along an elevated rod, and it does not firmly attach to the skate board so it will not remain in place while the board is raised, lowered or moved to another hanging location.

Prior art for snow board storage includes dedicated wall or ceiling mounted racks which have to be mechanically attached, cannot easily be relocated once installed, cannot support other types of sports boards or skis, and most do not have the benefits of vertically suspending the boards as mentioned above. There is a design (U.S. Pat. No. D 650460 S1 by Krol) which consists of plastic knobs which require mechanical attachment to a wall. These can be used to suspend a snowboard vertically but, can only support snowboards, require screw attachment to a wall, and the snow board must be installed in a flat orientation to the wall.

The same disadvantages mentioned above generally apply to currently available storage systems for sports boards and skis types not mentioned above.

Advantages:

Accordingly several advantages of one or more aspects are as follows: to provide a sports board hanger which can quickly and easily be attached and detached to a board and enable it to be suspended from an elevated rod, hook, peg or other object, that attaches without damaging the board, that does not require disassemble of any of the boards components to use, that can be reused, that can be used to support boards with the fins installed and with fixed or glassed-on fin systems, that can be used to display boards for viewing, and that attaches firmly to the board so that the hanger will remain in place with the top hook erectly protecting while the board is raised or lowered from hanging. This is advantageous as an elevated attachment point can be much higher than the user's typical reach, enabling sports boards to be hung at a higher location without use of a ladder or other assistance. Hanging the boards higher frees up usable space at the lower area of the room. Further, one elevated rod can to used support a variety of different types of sports boards such as surfboards, skateboards, snowboards, skis and others without having to construct, purchase and mechanically attach various dedicated racks for specific board types. Other advantages of one or more aspects will be apparent from consideration of the drawings and ensuing descriptions.

SUMMARY

In accordance with one embodiment a sports board hanger which can be attached to a board, enable it to be hung from an elevated rod, hook, peg or other object, remain erectly in place while the board is raised or lowered, can be quickly attached and detached for reuse without use of fasteners such as screws, and can be used with fins installed on a board.

DRAWINGS—FIGURES

In the drawings, closely related figures have the same number but different alphabetic suffixes.

REFERENCE NUMERALS

Figure 1A:
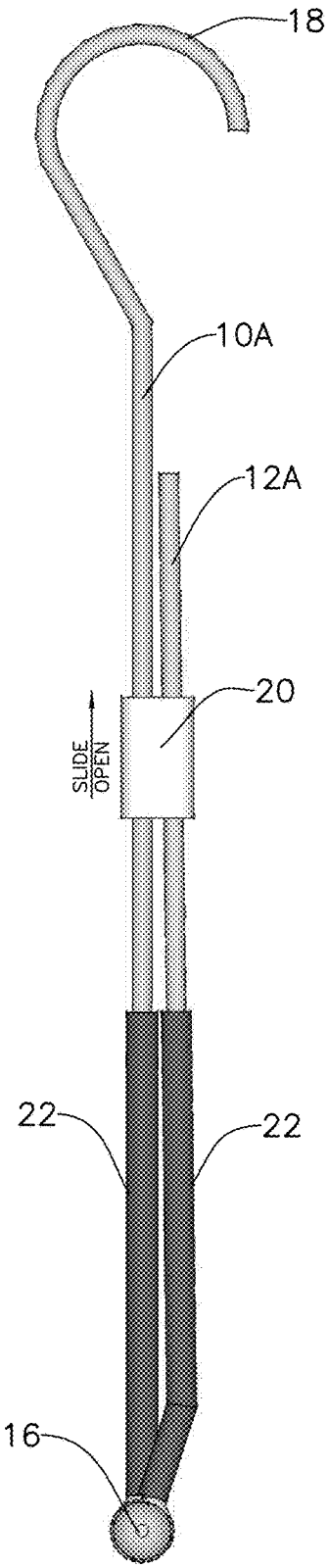
FIGS. 1A to 1G show various aspects of a hanger for use with a surfboard or other board with projecting fins in accordance with one embodiment.
Figure 1B:
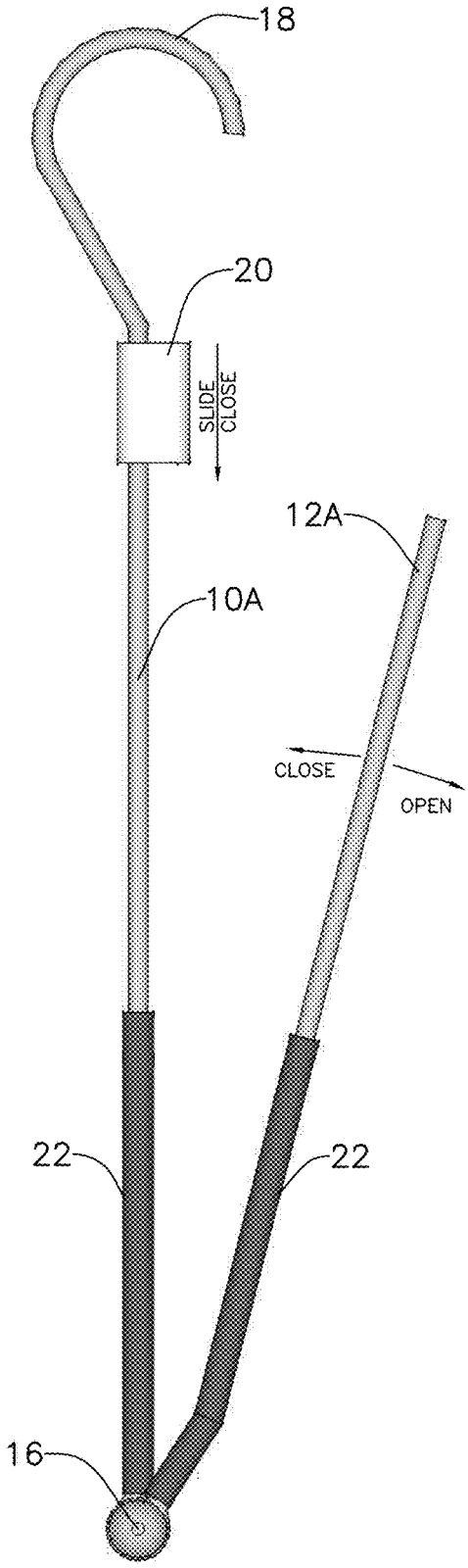

10A hook member
10B single member surfboard hanger
10C hook member for skateboard hanger
10D horizontal member for snowboard hanger
10E center horizontal member for ski hanger
12A pivot member
12B pivot leg for top interlock
12C pivot leg for skateboard hanger
12D pivot leg for snowboard hanger
12E pivot leg for ski hanger
14 formed circular hole
16 barrel nut and screw
18 top hook
20 sliding clasp
22 grip material covering
24 interlock connection
26 surfboard
28 fin
30 gap in single member
32 outer leg of single member
34 U-shape
36 skateboard
38 skateboard truck
40 snowboard
42 vertical hook member
44 weld location
46 horizontal tie member
48 shaped ends for snowboard and skis
50 angle brace (optional)
52 snowboard or ski edge
54 snow ski
56 sliding clasp with thumb screw
58 thumb screw
60 center horizontal member with grip material covering
62 horizontal U-shaped member with grip material covering

DETAILED DESCRIPTION

Figure 1C:
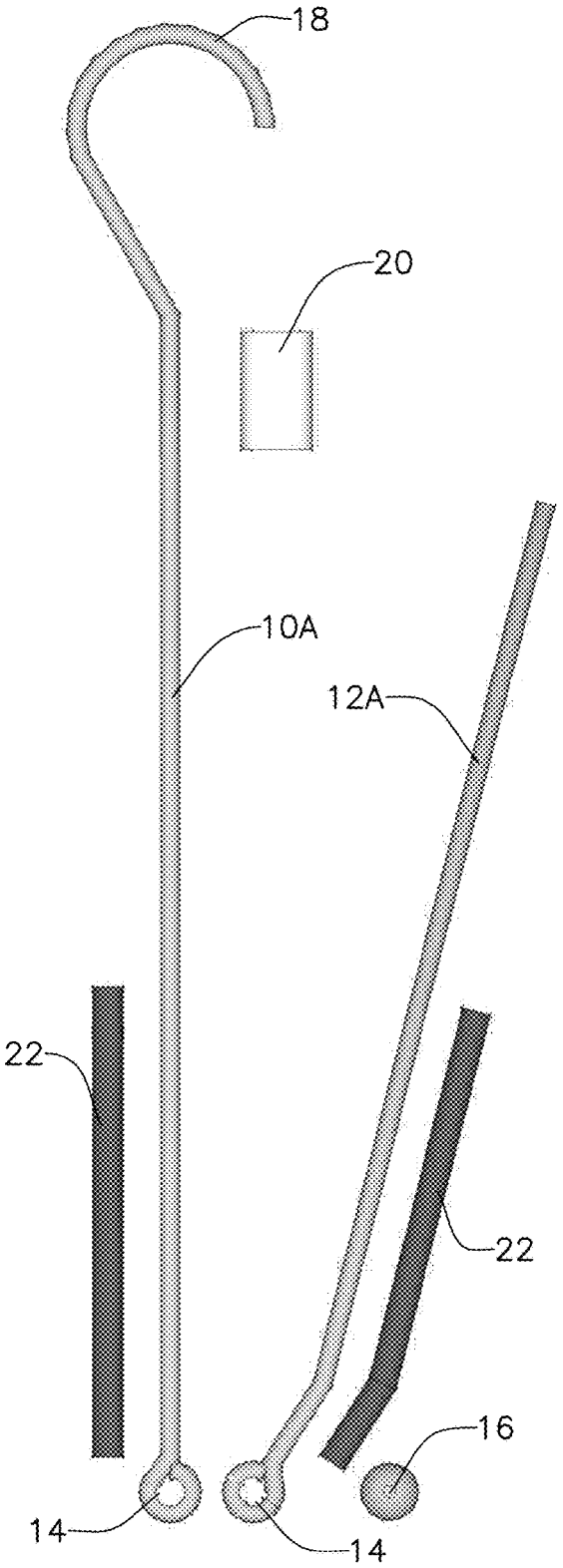
Figure 1D:
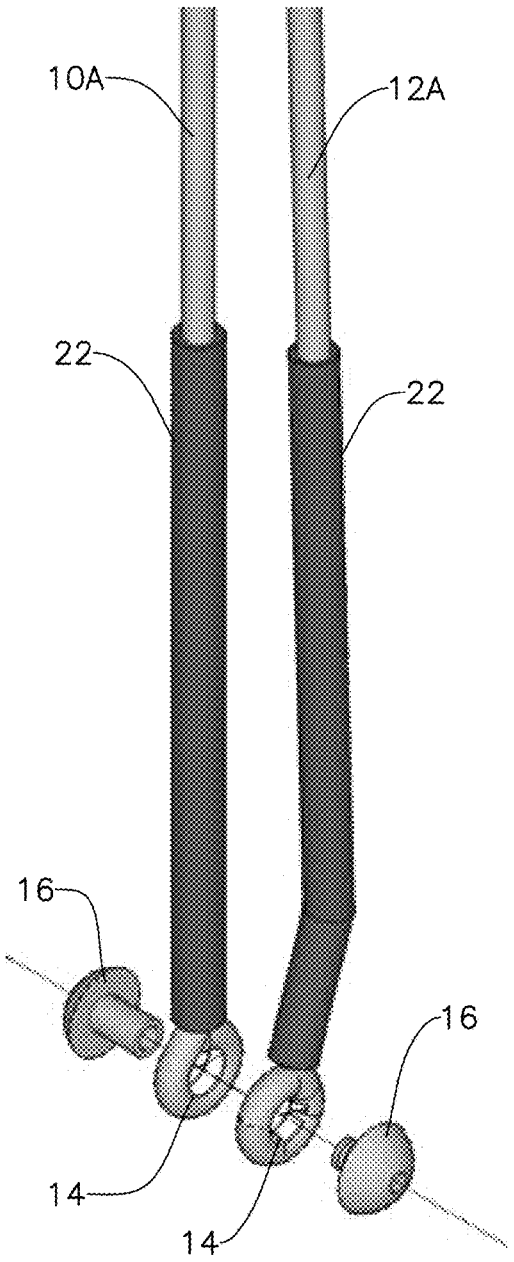
Figure 1E:
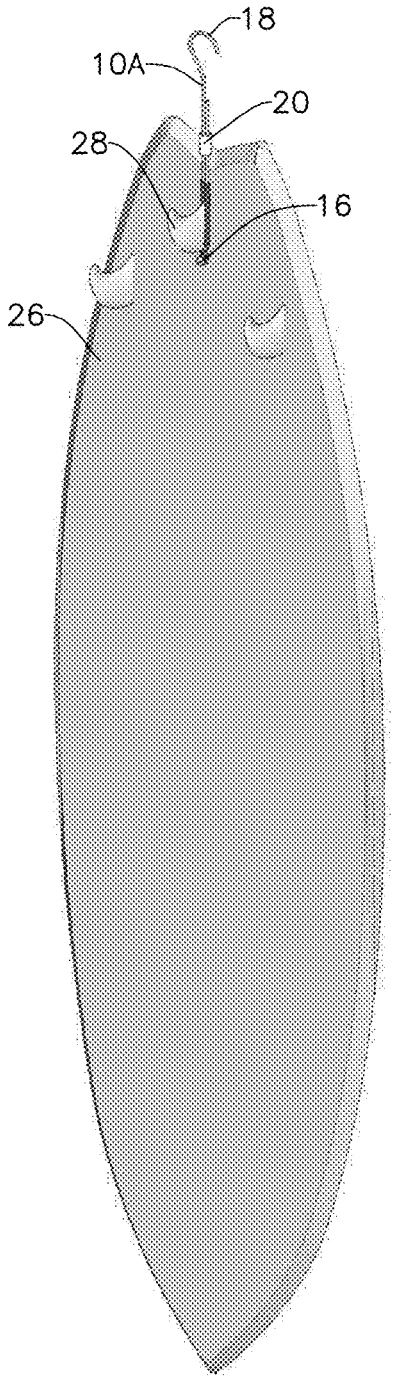
Figure 1F:
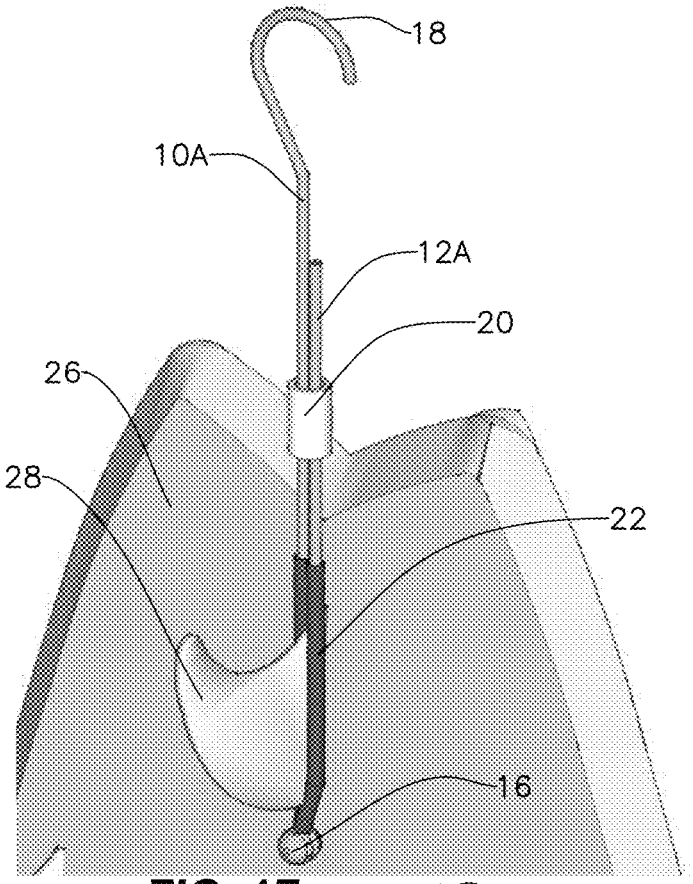
Figure 1G:
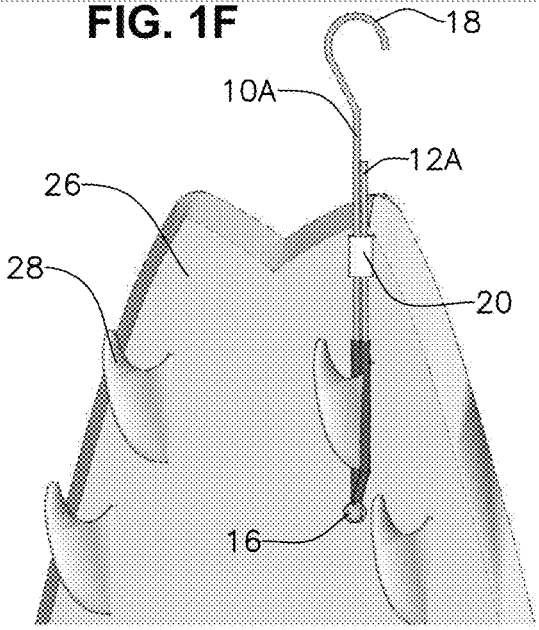

One embodiment of a hanger for use to suspend a surfboard 26 or other sport boards with projecting fins is illustrated in FIGS. 1A to 1G. FIG. 1A (front view closed) and FIG. 1B (front view open) illustrate the hanger which comprises a vertical hook member 10A with a formed open hook 18 at its top end and a formed circular hole 14 at its bottom end, and a pivot member 12A with a formed circular hole 14 at its bottom end. In one embodiment, hook member 10A and pivot member 12A are formed of round steel wire however other cross sectional shapes and materials could be used such as plastics, plastic composites, other metals, fibrous composites, etc. Hook member 10A and pivot member 12A are connected via the formed circular holes 14 with a barrel nut and screw 16 enabling pivot member 12A to rotate open and close. In other embodiments other types of fasteners such as rivets could be used in lieu of the barrel nut and screw 16. Hook member 10A and pivot member 12A are shaped to conform to the sides of a fin 28 on the surfboard 26 when in the closed position. A sliding clasp 20 is used to hold the upper part of pivot member 12A to hook member 10A in the closed position. In one embodiment, sliding clasp 20 consists of a short section of plastic pipe however other shapes, forms and materials could be used. A cushioning grip material 22 covering is applied to portions of hook member 10A and pivot member 12A which will contact the fin 28. In one embodiment, grip material 22 consists of a silicone rubber covering however other materials could be used such as other rubbers, vinyls, plastics, foams, etc. The hanger is closed when pivot member 12A is rotated next to the vertical section of hook member 10A and sliding clasp 20 is slide down to hold pivot member 12A in position. In other embodiments the top hook 18 could have different shapes and orientations. FIG. 1C shows an exploded front view of the hanger and FIG. 1D is an exploded isometric view of the lower portion of the hanger. FIG. 1C (exploded front view) illustrates separate components of the hanger. FIG. 1D is an exploded isometric view which illustrates the bottom section of hanger.

Operation—FIGS. 1A to 1G

From the closed position, the hanger is opened by sliding clasp 20 upward so pivot member 12A can be rotated open. From the open position the hanger can be installed over and down to the base of a fin 28 where it protrudes from the face of the surfboard 26. Pivot member 12A is then rotated closed so that the fin 28 is clamped between hook member 10A and pivot member 12A. Sliding clasp 20 is then slid downward to hold pivot member 12A in the closed position. In the closed position the hanger is attached to the fin 28 by the resulting clamping force enhanced at contact locations by the grip material 22 covering. The surfboard 26 can now be suspended from an elevated rod, hook, peg or other object by using the top hook 18. The top hook 18 will remain erectly projecting as the surfboard 26 is raised to or lowered from hanging, enabling the user to hang the surfboard 26 higher than the user's typical reach without the use of a ladder.

Figure 2A:
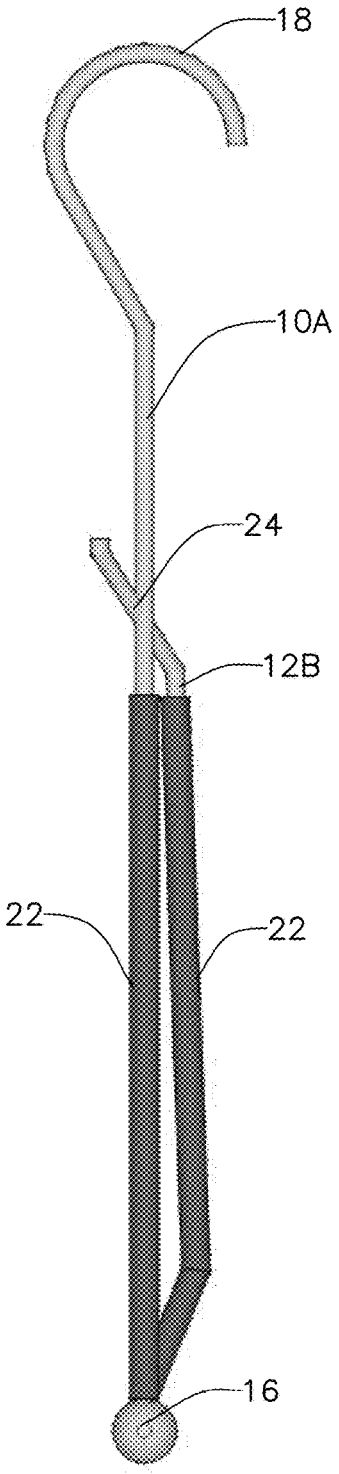
FIGS. 2A and 2B show various aspects of a hanger for use with a surfboard or other board with projecting fins which has an alternate closing method in accordance with another embodiment.
Figure 2B:
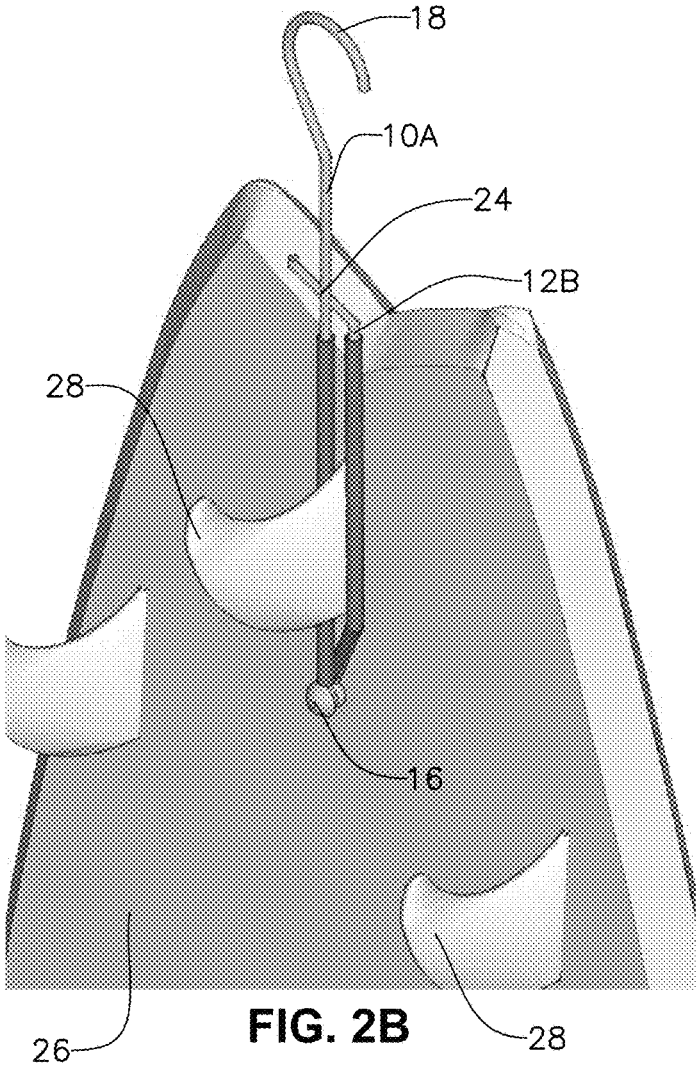

Another embodiment of a hanger for use to suspend a surfboard 26 or other sport boards with projecting fins is illustrated in FIGS. 2A and 2B. FIG. 2A (front view closed) and FIG. 2B (isometric view attached) illustrate the hanger which is similar in fabrication and operation to the hanger described and illustrated for FIGS. 1A to 1G except the top end of pivot member 12B is formed in such a way that it interlocks 24 with the upper part of hook member 10A. The interlock 24 holds pivot member 12B in closed position in lieu of a sliding clasp 20.

Figure 3A:
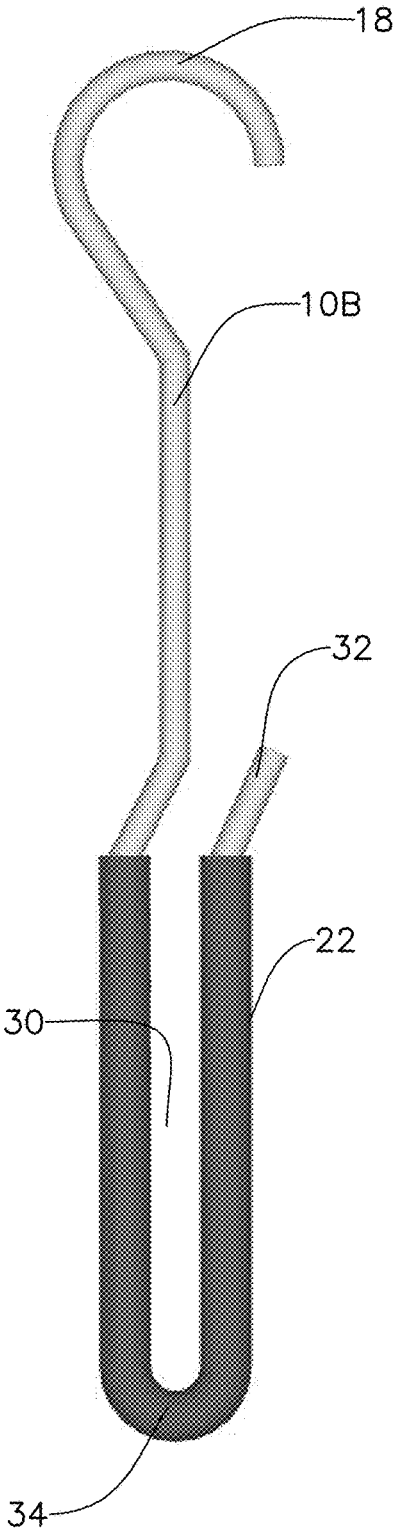
FIGS. 3A and 3B show various aspects of a hanger for use with a surfboard or other board with projecting fins which has a single formed member in accordance with another embodiment.
Figure 3B:
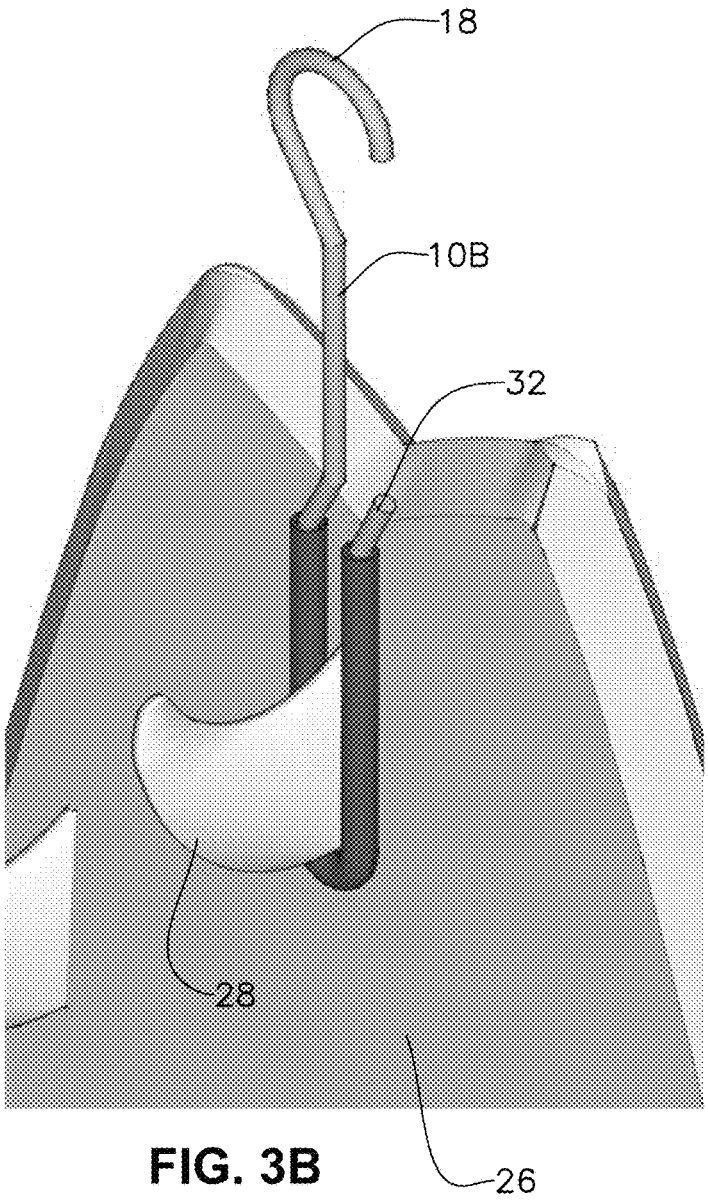

Another embodiment of a hanger for use to suspend a surfboard 26 or other sport boards with projecting fins is illustrated in FIGS. 3A and 3B. FIG. 3A (front view) and FIG. 3B (isometric view attached) illustrate the hanger which comprises a single formed member 10B which attaches to a fin 28 by a flexural spring type clamping force related to a gap 30 formed between an outer leg 32 and the hanger being less than the thickness of the fin 28 when attached. The clamping force is enhanced at contact locations by the grip material 22 covering. The single member 10B is formed with a top hook 18 and flexible U-shape 34 at its bottom end. In other embodiments the bottom end of the hanger could be formed in spring type coils or other shapes in lieu of the U-shape 34 to enhance the flexural clamping force of the hanger while maintaining the gap 30 which receives the fin 28. The hanger is attached by applying pressure to the outer leg 32 increasing the width of the gap 30 enough to slide the hanger down to the base of the fin 28 and then releasing the outer leg 32 thereby attaching the hanger. The hanger is detached by doing the same in reverse.

Figure 4A:
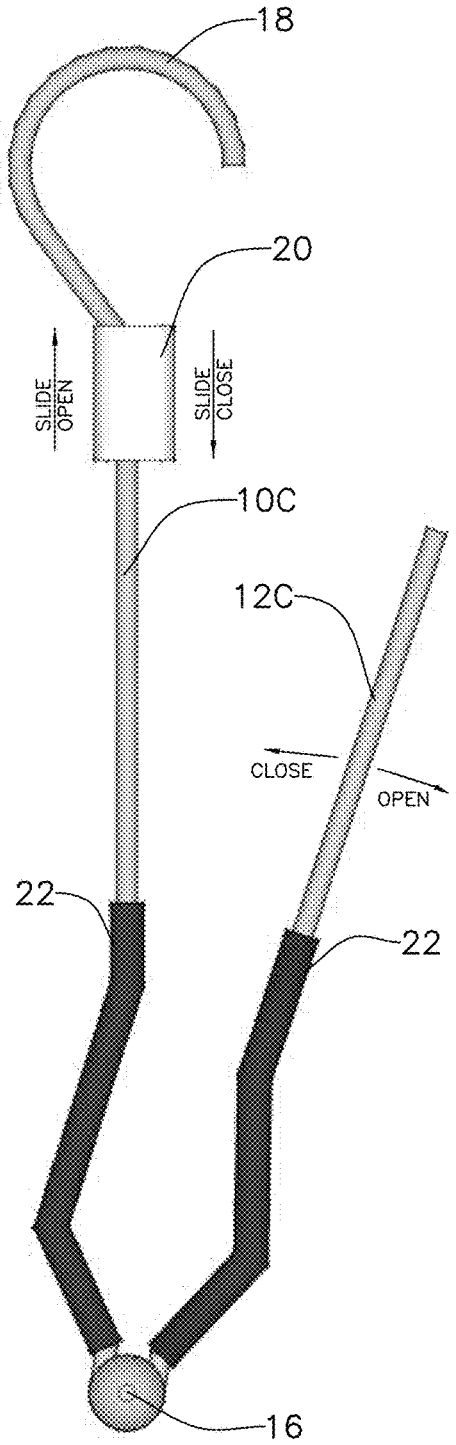
FIGS. 4A to 4C show various aspects of a hanger for use with a skateboard or other wheeled board in accordance with one embodiment.
Figure 4B:
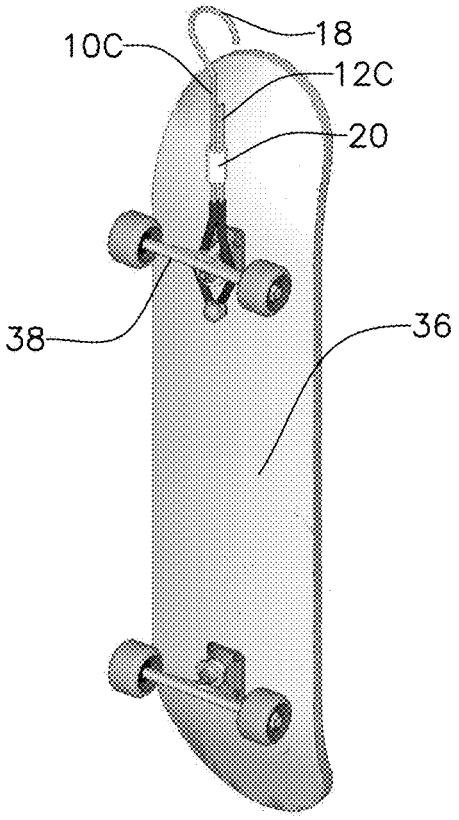
Figure 4C:
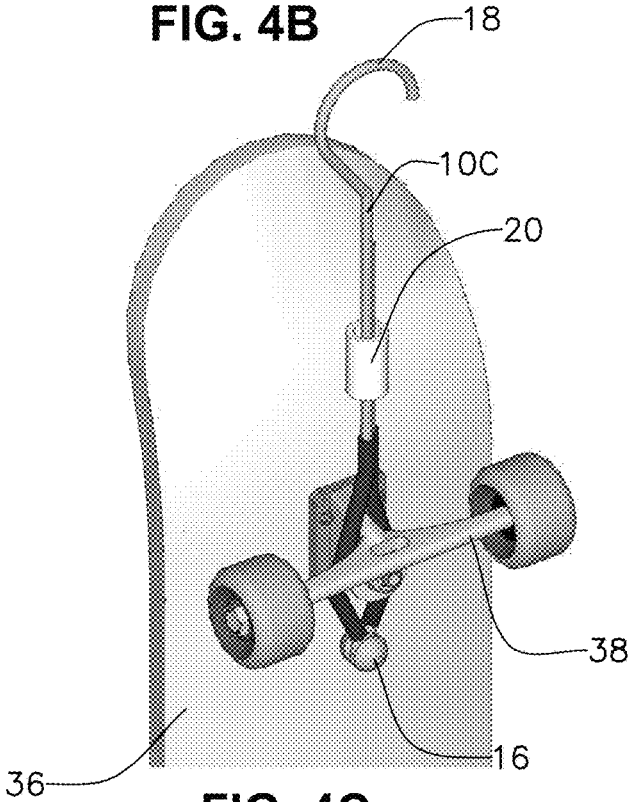

One embodiment of a hanger for use to suspend a skateboard 36 or other sport boards with wheels is illustrated in FIGS. 4A to 4C. FIG. 4A (front view open), and FIGS. 4B and 4C (isometric view attached) illustrate the hanger which is similar in fabrication and operation to the hanger described and illustrated for FIGS. 1A to 1G except hook member 10C and pivot member 12C are formed to conform to a skateboard truck 38 attached to the skateboard 36. When the pivot member 12C is closed against the truck 38 and sliding clasp 20 is lowered to hold pivot member 12C in the closed position, the hanger is attached and can be used to suspend the skateboard from an elevated rod, hook, peg or other object by using the top hook 18. In other embodiments the hanger could attach to other sections of the truck 38 or skateboard 36, or be a single formed member similar to that shown and described for 10B.

Figure 5A:
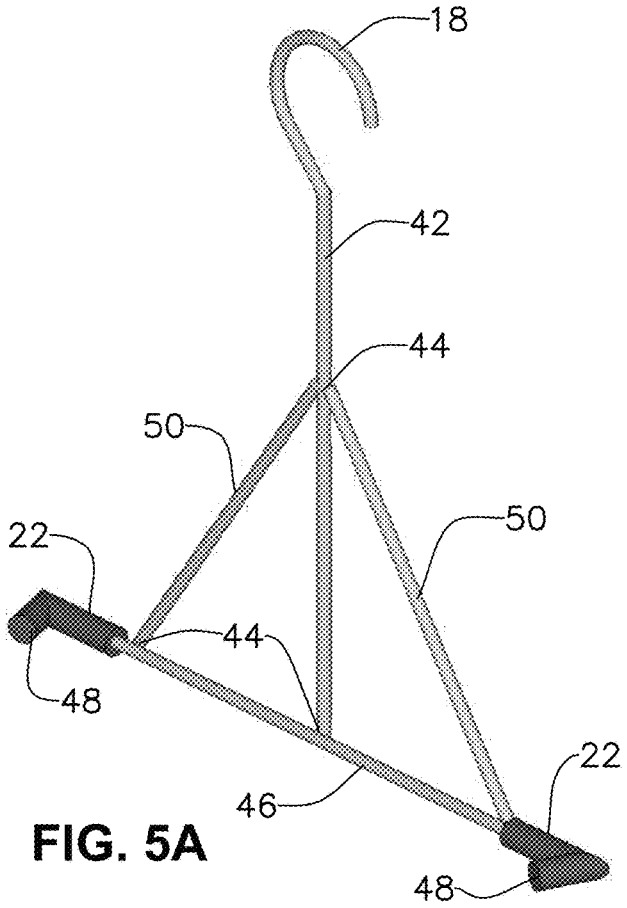
FIGS. 5A to 5E show various aspects of a hanger for use with a snowboard in accordance with one embodiment.
Figure 5B:
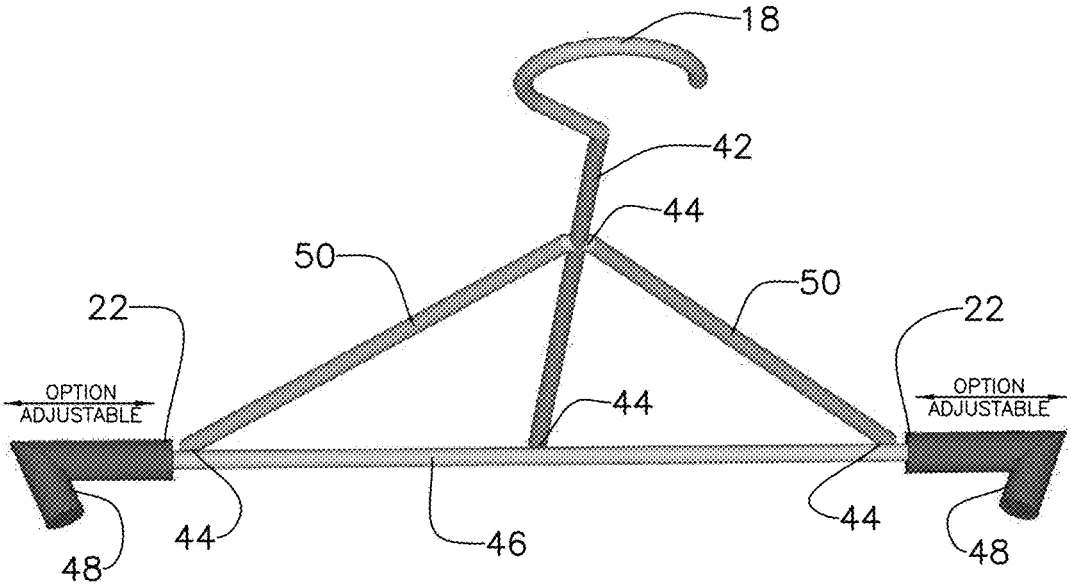
Figure 5C:
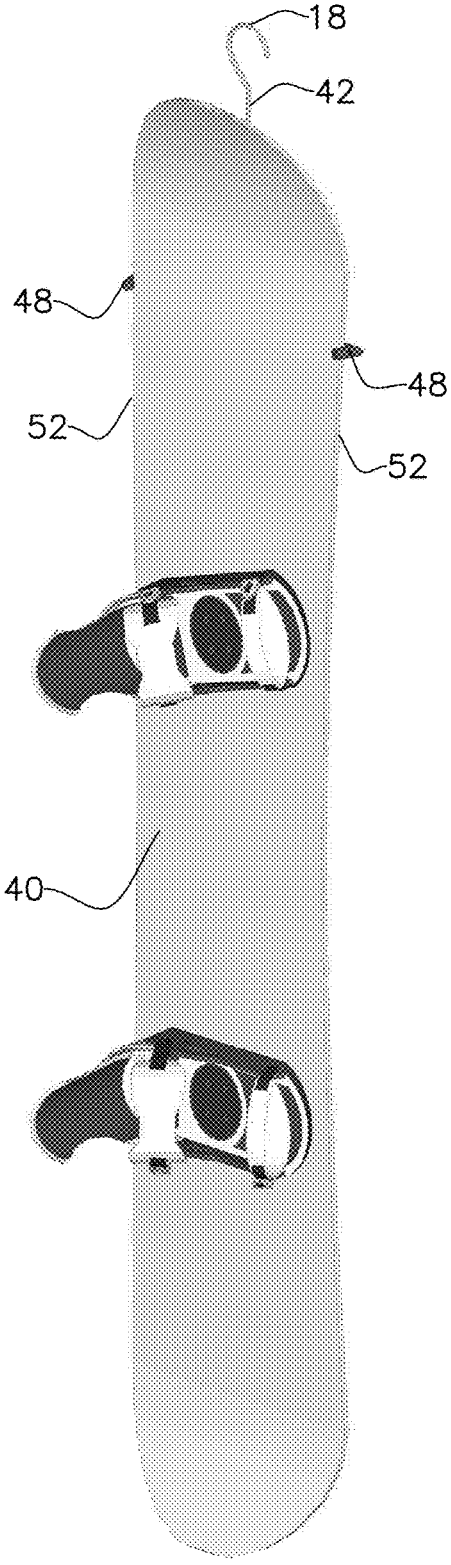
Figure 5D:
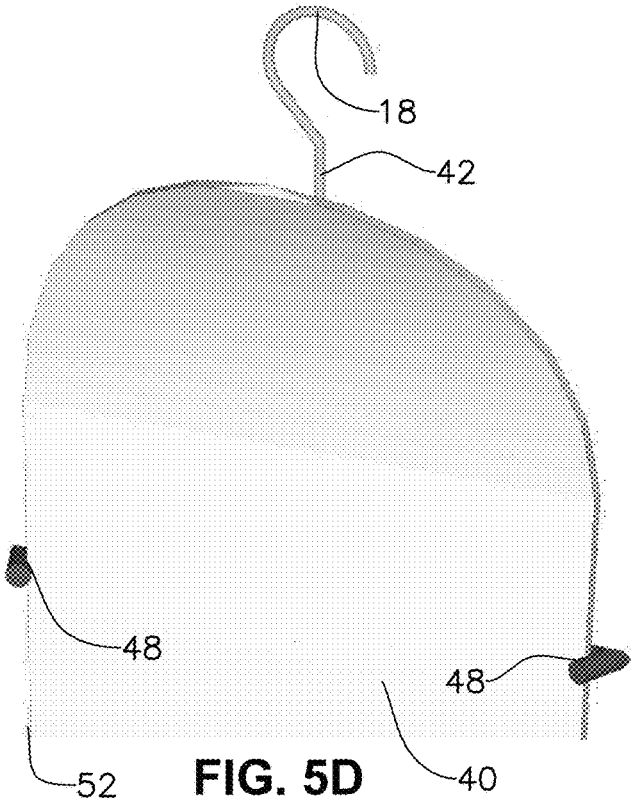
Figure 5E:
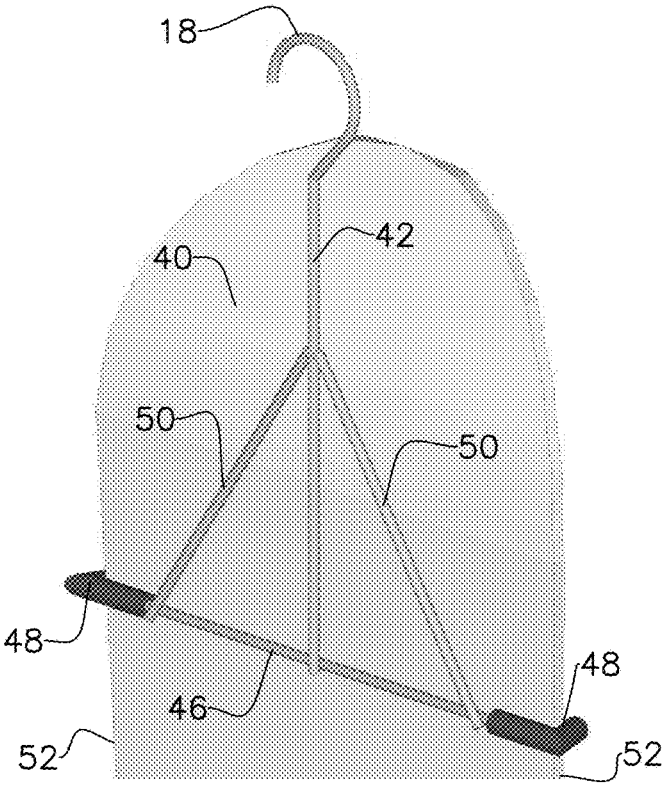

One embodiment of a hanger for use to suspend a snowboard 40 is illustrated in FIGS. 5A to 5E. FIG. 5A (isometric view) and FIG. 5B (tilted top view) illustrate the hanger which comprises a horizontal tie member 46 with each end shaped 48 to conform to the snowboard's edges 52. The length of tie member 46 between the shaped ends 48 is longer than the narrowest waist width of the snowboard 40 but shorter than the widest width at each end. The shaped ends 48 are covered with a cushioning grip material covering 22. In one embodiment, grip material 22 consists of a silicone rubber covering however other materials could be used such as other rubbers, vinyls, plastics, foams, etc. A vertical hook member 42 with a formed open hook 18 at its top end is connected at its lower end to the mid-point of the horizontal tie member 46 by welds 44. Optional angle brace members 50 may be included to stiffen the connection between the hook member 42 and the tie member 46. In one embodiment, hook member 42, tie member 46, and brace members 50 are formed of round steel wire however other cross sectional shapes and materials could be used such as plastics, plastic composites, other metals, fibrous composites, etc. The shaped ends 48 are formed such that the hanger attaches firmly to the snowboard 40 when the hanger is pulled upward to wedge against the snowboard's edges 52. In other embodiments the shaped ends 48 could be made as separate pieces, of various materials and be attached to the tie member 46 in such a way that they can be adjusted to accommodate various snowboard widths and to increase the clamping force and grip of the hanger while attaching and while attached. FIGS. 5C and 5D are isometric front side views of the hanger attached to a snowboard 40 and FIG. 5E is an isometric back side view of the hanger attached.

Operation—FIGS. 5A to 5E

With the tie member 46 of the hanger on the bottom side of the snowboard 40, the hanger is attached by lowering the shaped ends 48 of the tie member 46 below the widest width of the end of the snowboard 40. The hanger is then pushed toward the snowboard 40 until the back of the shaped ends 48 contact the bottom of the snowboard 40. The hanger is then pulled upward in such a way that the shaped ends 48 wedge against the widening edges 52 of the snowboard 40 forming an attachment to the snowboard 40. The snowboard 40 can then be raised to be hung from an elevated object. The hanger is detached by pushing downward and then outward on the shaped ends 48. In other embodiments with the shaped ends 48 made as separate pieces and attached to the tie member 46, the shaped ends 48 can be adjusted to accommodate various snowboard widths and to actively increase the clamping force and grip of the hanger.

Figure 6A:
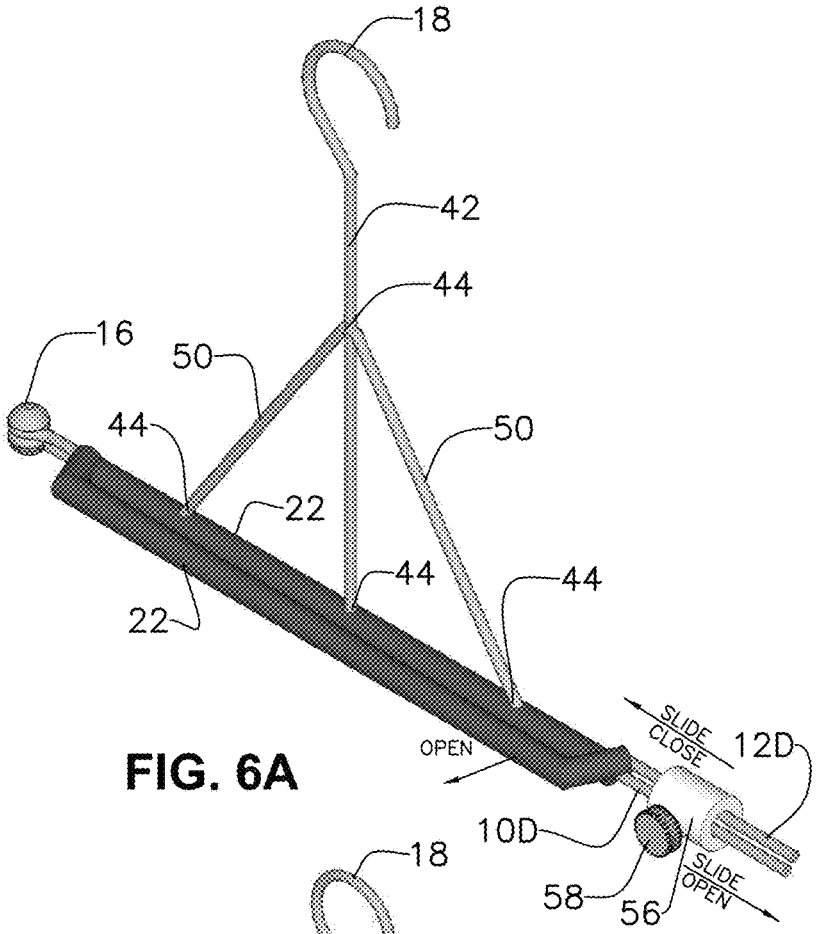
FIGS. 6A to 6D show various aspects of a hanger for use with a snowboard in accordance with another embodiment.
Figure 6B:
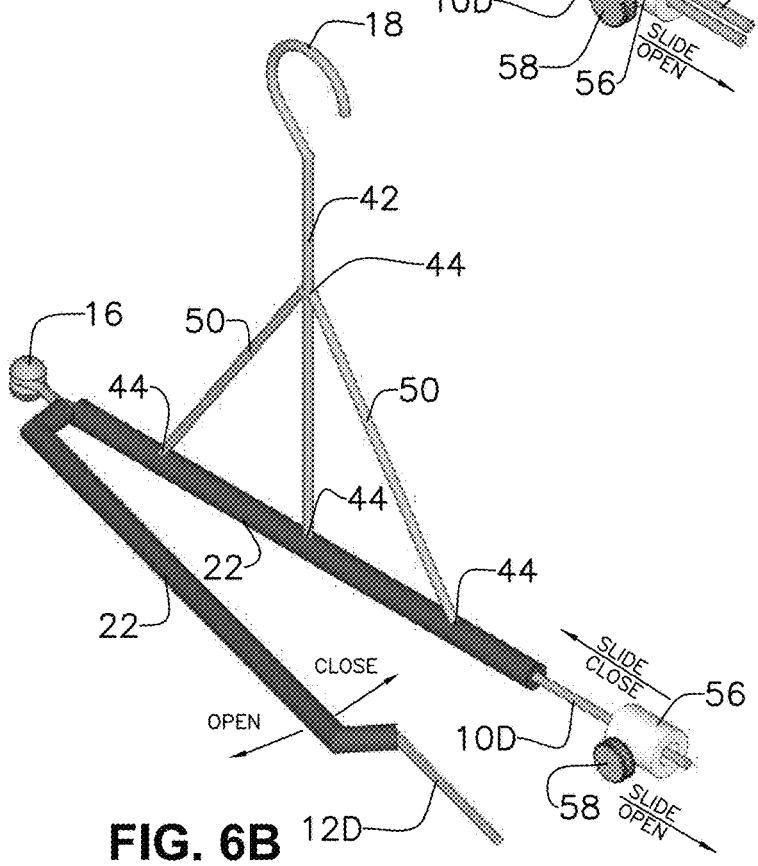

Another embodiment of a hanger for use to suspend a snowboard 40 is illustrated in FIGS. 6A to 6D. FIG. 6A (front isometric view closed) and FIG. 6B (front isometric view open) illustrate the hanger which is similar in fabrication and operation to the hanger described and illustrated for FIGS. 1A to 1G except horizontal member 10D and pivot member 12D are in a horizontal orientation and formed to conform to one end of the snowboard 40. Horizontal member 10D and pivot member 12D have formed circular holes 14 (as shown in FIGS. 1C and 1D) at one end. Horizontal member 10D and pivot member 12D are connected via the formed circular holes 14 with a barrel nut and screw 16 enabling pivot member 12D to rotate open and close. A cushioning grip material 22 covering is applied to portions of horizontal member 10D and pivot member 12D which will contact the snowboard 40. A vertical hook member 42 with a formed open hook 18 at its top end is connected at its lower end to the mid-point of the horizontal member 10D by welds 44. Optional angle brace members 50 may be included to stiffen the connection between the hook member 42 and the horizontal member 10D.

Operation—FIGS. 6A to 6D

Figure 6C:
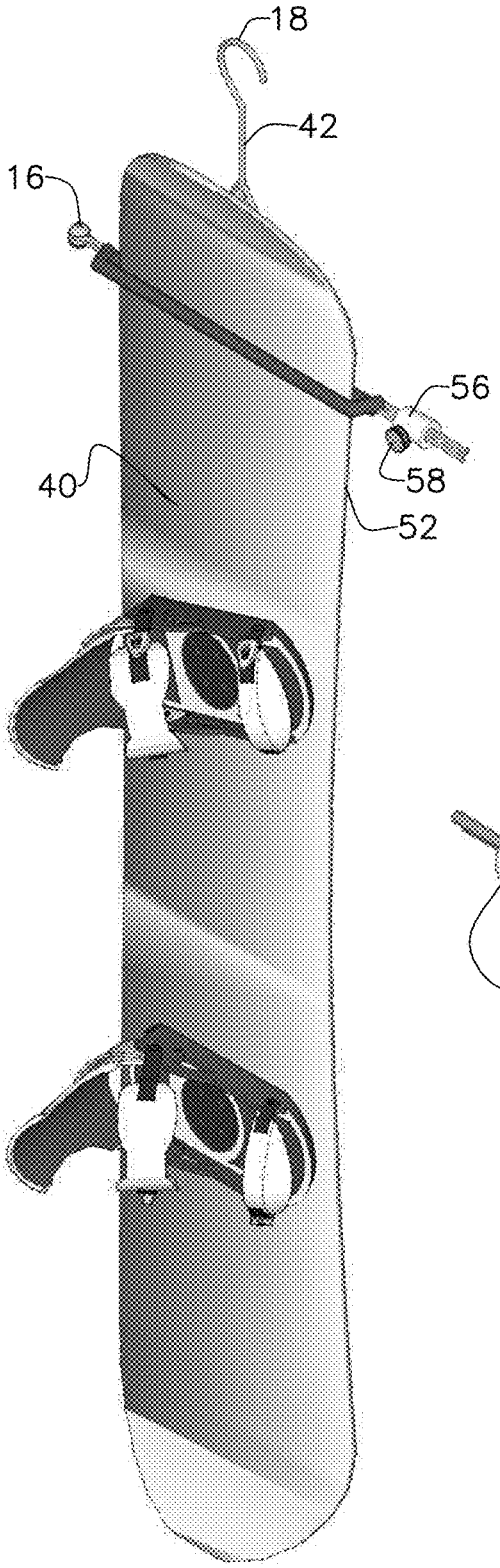
Figure 6D:
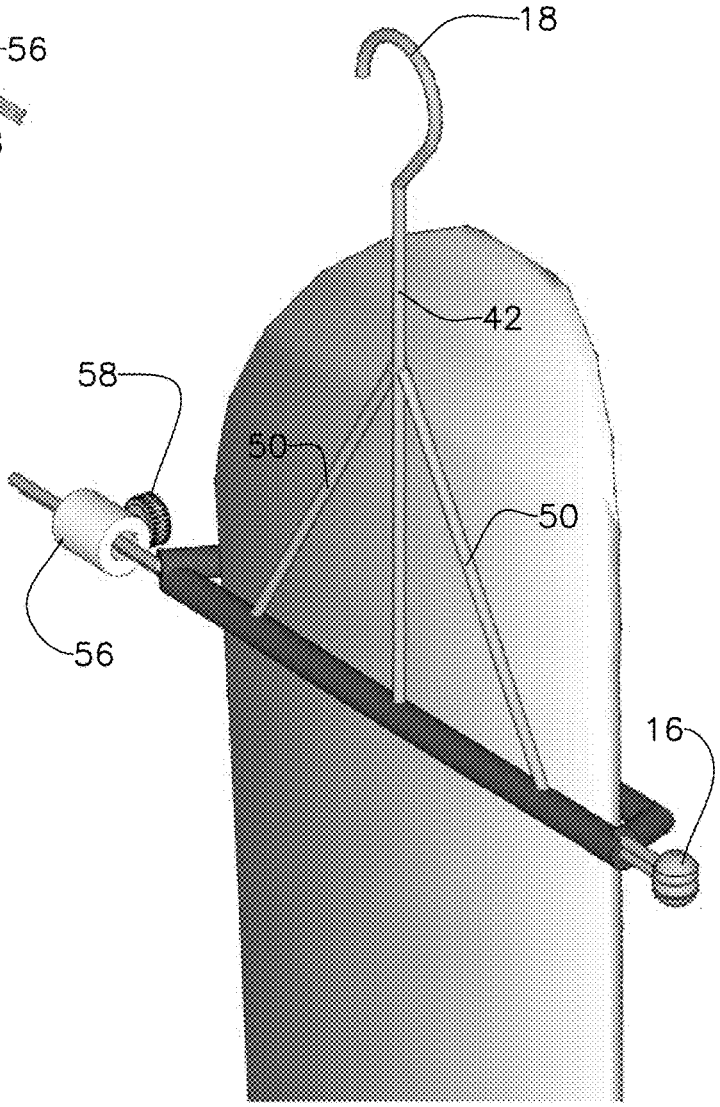

The hanger is attached by clamping one end of the snowboard 40 between horizontal member 10D and pivot member 12D and moving the sliding clasp 56 inward to hold the pivot member 12D in the closed position which produces a clamping grip force enhanced by the grip material 22. An optional thumb screw 58 may be included in the sliding clasp 56 which can be tightened to help hold the sliding clasp in position. The attached hanger can be used to suspend the snowboard from an elevated rod, hook, peg or other object by using the top hook 18. In other embodiments, the top hook 18 could have different shapes and orientations. FIG. 6C is an isometric front side view of the hanger attached to a snowboard 40 and FIG. 6D is an isometric back side view of the hanger attached.

Figure 7A:
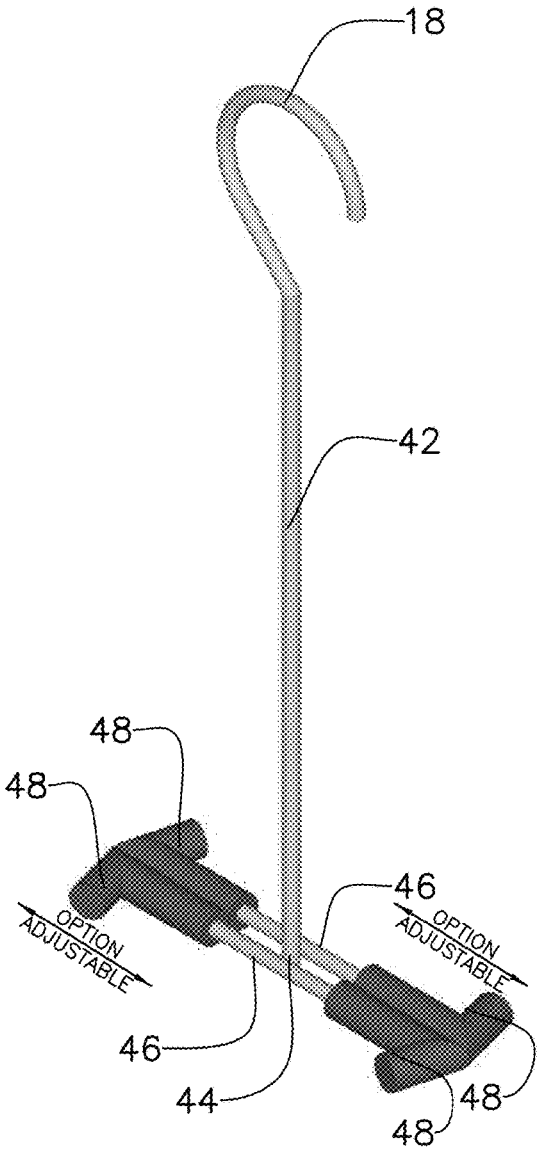
FIGS. 7A and 7B show various aspects of a hanger for use with snow skis or other skis in accordance with one embodiment.
Figure 7B:
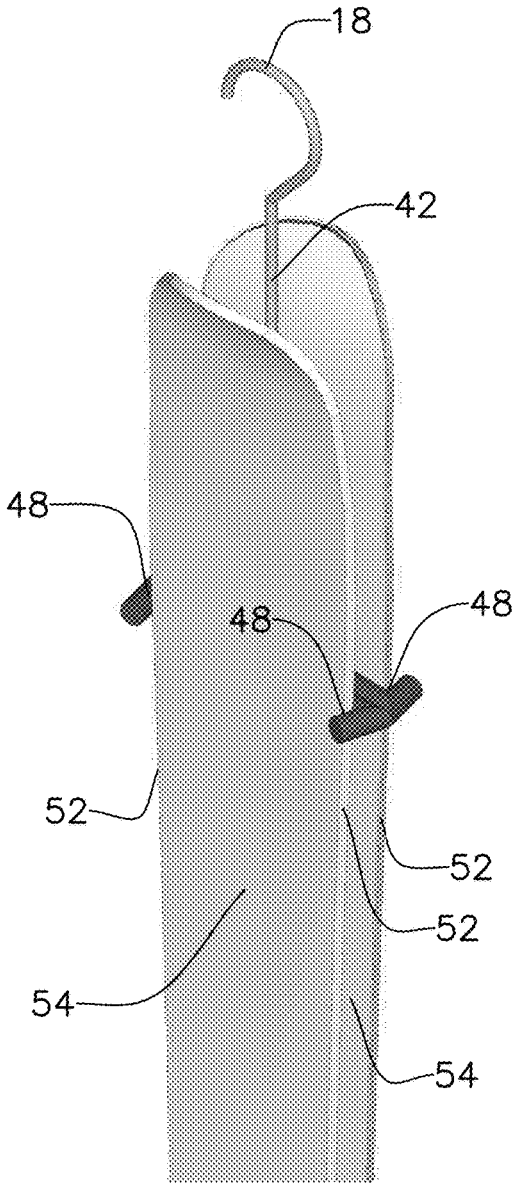

One embodiment of a hanger for use to suspend snow skis 54 or other sport skis is illustrated in FIGS. 7A and 7B. FIG. 7A (isometric view hanger only) and FIG. 7B (isometric view attached) illustrate the hanger which is similar in fabrication and operation to the hanger described and illustrated for FIGS. 5A to 5E except formed to suspend a pair of skis 54. The hanger has two horizontal tie members 46 with shaped ends 48 to conform to the edges 52 of the skis 54. The shaped ends 48 are covered with a cushioning grip material covering 22. In other embodiments, a single horizontal tie member 46 could be used and the shaped ends 48 could be made as separate pieces and of various materials and be attached to the tie member 46 in such a way that they can be adjusted to accommodate various ski widths and to increase the clamping force and grip of the hanger while attaching and while attached. In other embodiments, the top hook 18 could have different shapes and orientations. The hanger can be used to suspend a single ski 54 or a pair of skis from an elevated rod, hook, peg or other object by using the top hook 18.

Figure 8A:
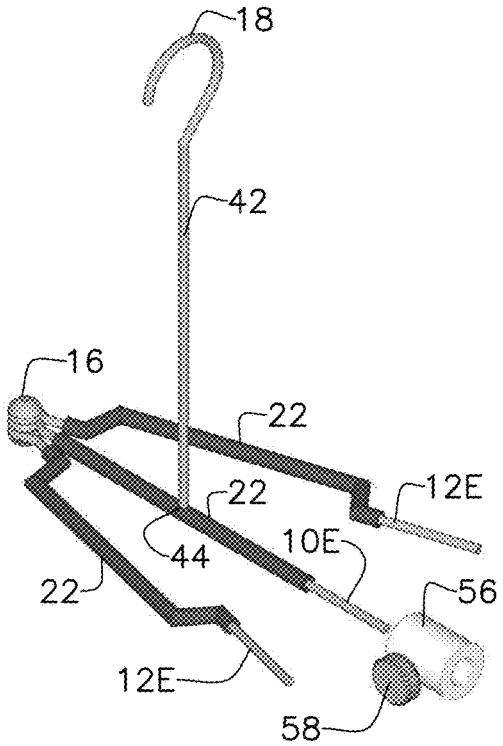
FIGS. 8A and 8B show various aspects of a hanger for use with snow skis or other skis in accordance with another embodiment.
Figure 8B:
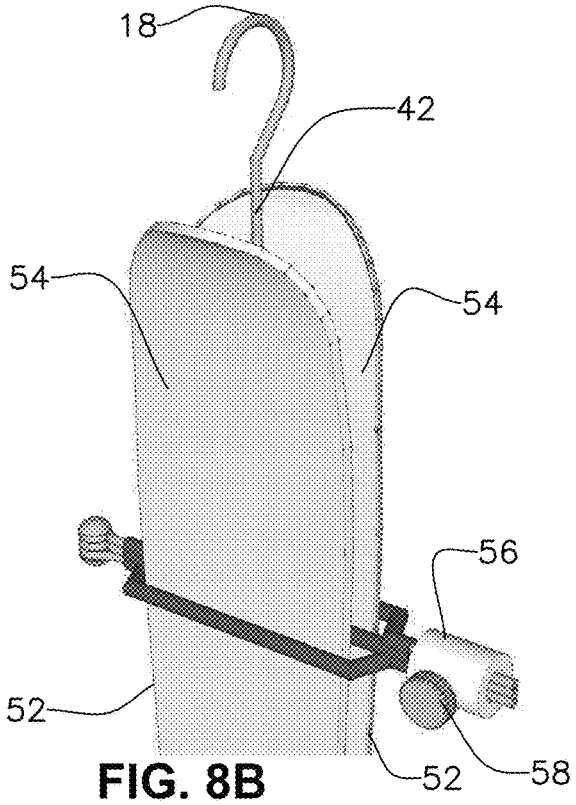

Another embodiment of a hanger for use to suspend snow skis 54 or other sport skis is illustrated in FIGS. 8A and 8B. FIG. 8A (isometric view hanger only) and FIG. 8B (isometric view attached) illustrate the hanger which is similar in fabrication and operation to the hanger described and illustrated for FIGS. 6A to 6D except formed to suspend a pair of skis 54. The hanger has two pivot members 12E and a center horizontal member 10E which have formed circular holes 14 (as shown in FIGS. 1C and 1D) at one end. Pivot members 12E and center horizontal member 10E are connected via the formed circular holes 14 with a barrel nut and screw 16 enabling pivot members 12E to rotate open and close. A vertical hook member 42 with a formed open hook 18 at its top end is connected at its lower end to the mid-point of the center horizontal member 10E by welds 44. Optional angle brace members 50 (as shown in FIG. 6A) may be included to stiffen the connection between the hook member 42 and the center horizontal member 10E.

Figure 9A:
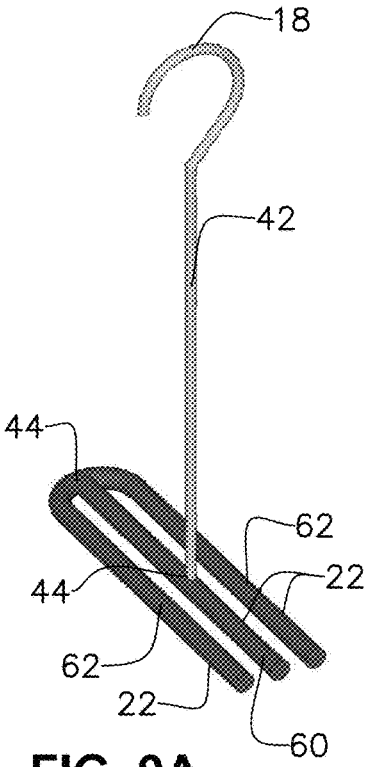
FIGS. 9A and 9B show various aspects of a hanger for use with snow skis or other skis in accordance with another embodiment.
Figure 9B:
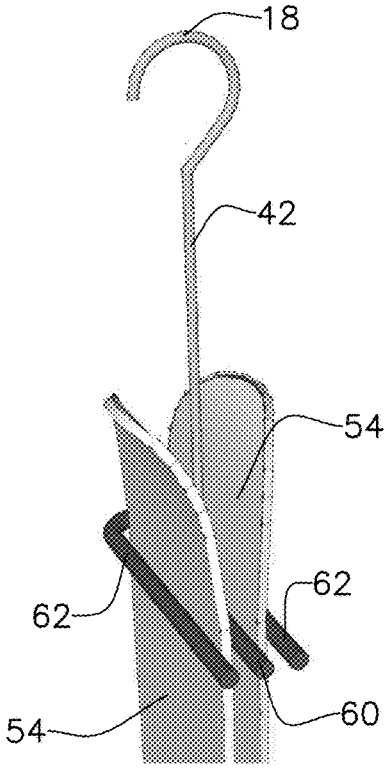

Another embodiment of a hanger for use to suspend snow skis 54 or other sport skis is illustrated in FIGS. 9A and 9B. FIG. 9A (isometric view hanger only) and FIG. 9B (isometric view attached) illustrate the hanger which comprises a horizontal U-shaped member 62 and a horizontal center member 60. One end of the center member 60 is welded 44 between the horizontal legs of the U-shaped member 62 to form two equal width gaps that the skis 54 can be slid into. A cushioning grip material 22 covering is applied to the U-shaped member 62 and center member 60. A vertical hook member 42 with a formed open hook 18 at its top end is connected at its lower end to the mid-point of the center horizontal member 60 by welds 44. Optional angle brace members 50 (as shown in FIG. 5A) may be included to stiffen the connection between the hook member 42 and the center horizontal member 60. The hanger is attached by sliding the tops ends of the skis 54 into the gaps between the center member 60 and the U-shaped member 62. The hanger can then be used to suspend a single ski 54 or a pair of skis from an elevated rod, hook, peg or other object by using the top hook 18. In other embodiments, the top hook 18 could have different shapes and orientations.

Although the descriptions for all the embodiments referenced above contain many specificities, these should not be construed as limiting the scope of the embodiments, but as exemplifications of various embodiments thereof. Many other ramifications and variations are possible within the teachings of the various embodiments. For example, in other embodiments members which have be illustrated formed of round steel wire could be made with other cross sectional shapes and other materials such as woods, plastics, plastic composites, other metals, fibrous composites, etc., other types of fasteners, such as rivets, could be used in lieu of the barrel nut and screw 16, the top hook 18 could have different shapes, orientations and be adjustable, for grip material 22, in lieu of silicone rubber covering other materials could be used such as other rubbers, vinyls, plastics, etc., and members could be made of different lengths and shapes than illustrated.

Thus the scope should be determined by the appended claims and their legal equivalents, rather than by the examples given.

The invention claimed is:

1. An article for suspending a sports board from an elevated object comprising:

a. at least one contacting member shaped to contact at least one component of said sports board so as to form a clamping friction attachment to said sports board without the use of any fasteners, outside said article, to attach said article to said sports board, and b. at least one clasping member which can be moved against the contacting member to maintain said clamping friction attachment, and c. at least one rigid supporting member shaped with an open hook at its top so it may be supported by an elevated object whereby said article will remain attached to and erectly projecting from said sports board while said sports board is raised to and lowered from support by an elevated object.

2. The article of claim 1 which can be used to suspend a surfboard or other sports board with projecting fins, with one or all fins installed in said surfboard or other sports board with projecting fins.

3. The article of claim 1 which can be used to suspend a skateboard or other sport boards with wheels.

4. The article of claim 1 which can be used to suspend a snowboard.

5. The article of claim 1 which can be used to suspend snow skis or other skis.

6. The article of claim 1 which can be used to suspend foam body boards.

7. A method for suspending a sports board from an elevated object comprising:

providing an article with:

a. at least one contacting member shaped to contact at least one component of said sports board so as to form a clamping friction attachment to said sports board without the use of any fasteners, outside said article, to attach said article to said sports board, and b. at least one clasping member which can be moved against the contacting member to maintain said clamping friction attachment, and c. at least one rigid supporting member shaped with an open hook at its top so it may be supported by an elevated object attaching said article to a sports board so that said article will remain attached to and erectly projecting from said sports board while said sports board is raised to and lowered from support by an elevated object.

8. The method of claim 7 which can be used to suspend a surfboard or other sports board with projecting fins, with one or all fins installed in said surfboard or other sports board with projecting fins.

9. The method of claim 7 which can be used to suspend a skateboard or other sport boards with wheels.

10. The method of claim 7, which can be used to suspend a snowboard.

11. The method of claim 7, which can be used to suspend snow skis or other skis.

12. The method of claim 7, which can be used to suspend foam body boards.

* * * * *